US006543681B1

(12) United States Patent
Wiederrecht et al.

(10) Patent No.: US 6,543,681 B1
(45) Date of Patent: Apr. 8, 2003

(54) MECHANICAL GOLF COUNTER

(76) Inventors: Jean-Marc Wiederrecht, 40, chemin Guillon, 1233 Bernex (CH); Carlos Freire, 11, avenue de Floreal, 1008 Prilly (CH)

( * ) Notice: Subject to any disclaimer, the term of this patent is extended or adjusted under 35 U.S.C. 154(b) by 210 days.

(21) Appl. No.: 09/702,675

(22) Filed: Nov. 1, 2000

(30) Foreign Application Priority Data

Nov. 3, 1999 (EP) ..... 99121783

(51) Int. Cl.[7] ..... G06C 29/00
(52) U.S. Cl. ..... 235/60 C; 235/21
(58) Field of Search ..... 235/1 B, 1 C, 235/19, 20, 21, 60 C; 377/5; D10/46.1; 116/200, 309; 273/DIG. 26

(56) References Cited

U.S. PATENT DOCUMENTS

| | | | | |
|---|---|---|---|---|
| 1,714,070 A | | 5/1929 | Beskow | 235/1 B |
| 5,550,884 A | * | 8/1996 | Berney | 473/283 |
| 5,769,740 A | * | 6/1998 | Colangelo | 473/283 |

FOREIGN PATENT DOCUMENTS

| | | | | |
|---|---|---|---|---|
| CH | 663318 A | * | 12/1987 | G04B/47/06 |
| DE | 3816713 A1 | | 11/1989 | |
| DE | 3816713 A1 | * | 11/1989 | A63B/71/06 |
| DE | 19725078 A1 | | 12/1998 | |
| EP | 987610 A1 | * | 3/2000 | G04B/47/00 |
| WO | WO 00/54116 | * | 9/2000 | A63B/71/06 |

* cited by examiner

*Primary Examiner*—Michael G. Lee
*Assistant Examiner*—Diane I. Lee
(74) *Attorney, Agent, or Firm*—Young & Thompson

(57) ABSTRACT

A golf counter has an entirely mechanical mechanism which includes a first lever actuated by a first pushbutton provided at its end with a nose coacting with a first star wheel carrying the movable member of the counter of the number of strokes per hole and subject to the action of a spring detent and a spiral spring. This mechanism includes a second lever whose first arm is subject to the action of a return spring and operationally connected to a second pushbutton, this first arm having a nose coacting with the teeth of the second star wheel carrying the movable member of the counter of the hole number. A second arm of the second lever actuates during its pivoting under the action of the second pushbutton the spring detent thereby freeing the first star wheel leading to its zero resetting by the spiral spring.

8 Claims, 3 Drawing Sheets

MECHANICAL GOLF COUNTER

FIELD OF THE INVENTION

The present invention relates to golf counters and particularly to those of the type permitting displaying mechanically from pushers or other manipulating members, the number of holes played, the number of strokes per hole, and the total strokes per round.

BACKGROUND OF THE INVENTION

Such counters are known, which operate electrically or electronically with stepping motors or integrated circuits. Such embodiments are cumbersome, large and complicated and do not lend themselves to the production of a high class product in small quantities.

SUMMARY OF THE INVENTION

The object of the present invention is to permit the production of golf counters of the mentioned type, which are purely mechanical and which, accordingly, can be made in small quantities and of high quality.

Another object of the present invention is to permit the production of a mechanical module of a golf counter, which can be integrated into a preferably mechanical wristwatch, between the movement and the dial of this watch.

The present invent has for its object a mechanical golf counter.

The present invention has for its object a mechanical golf counter which is distinguished by the characteristics set forth in claim 1.

BRIEF DESCRIPTION OF THE DRAWINGS

The accompanying drawings illustrate schematically an embodiment of the golf counter according to the invention.

DESCRIPTION OF THE PREFERRED EMBODIMENTS

Figure 1:
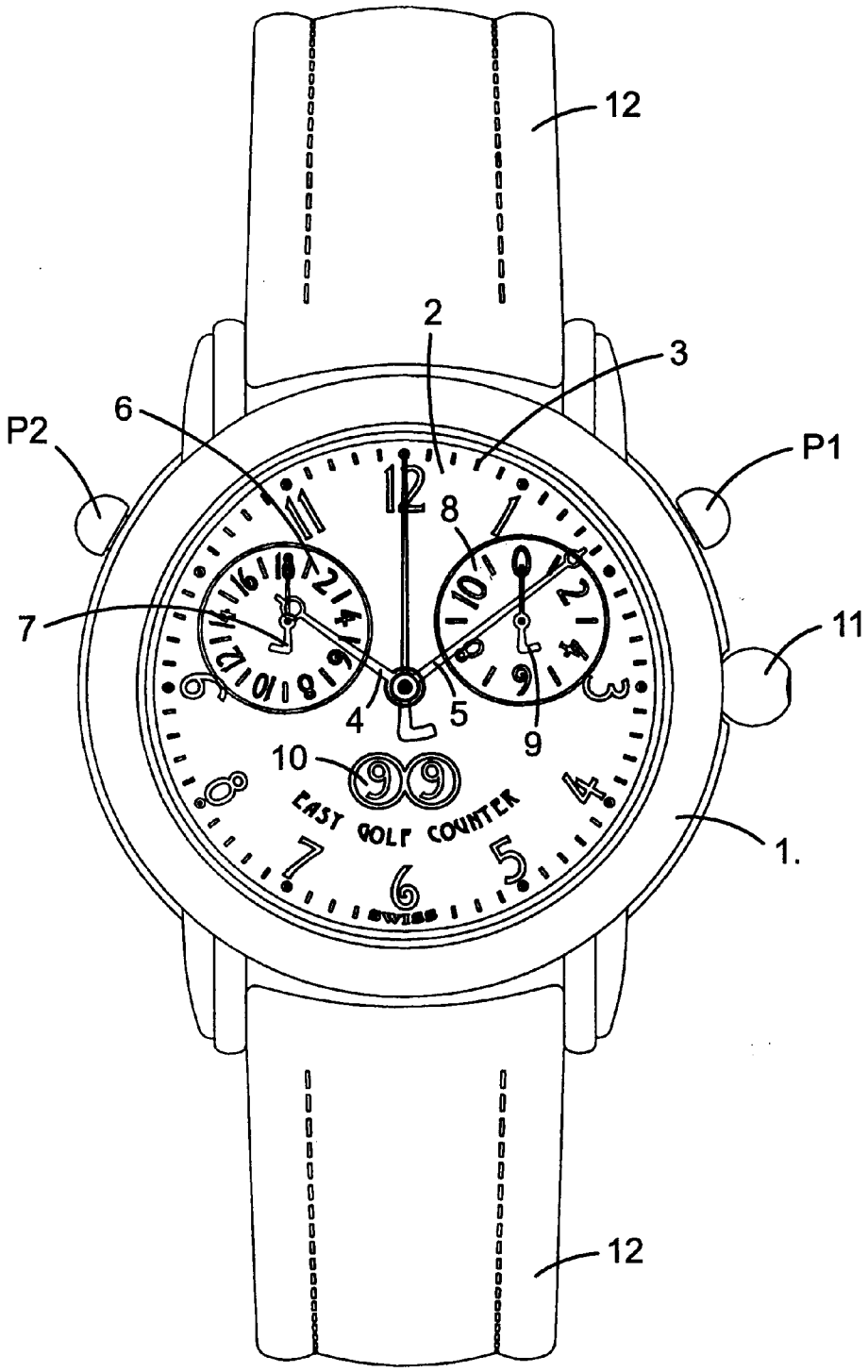
FIG. 1 shows a wristwatch provided with a golf counter according to the invention.
Figure 2:
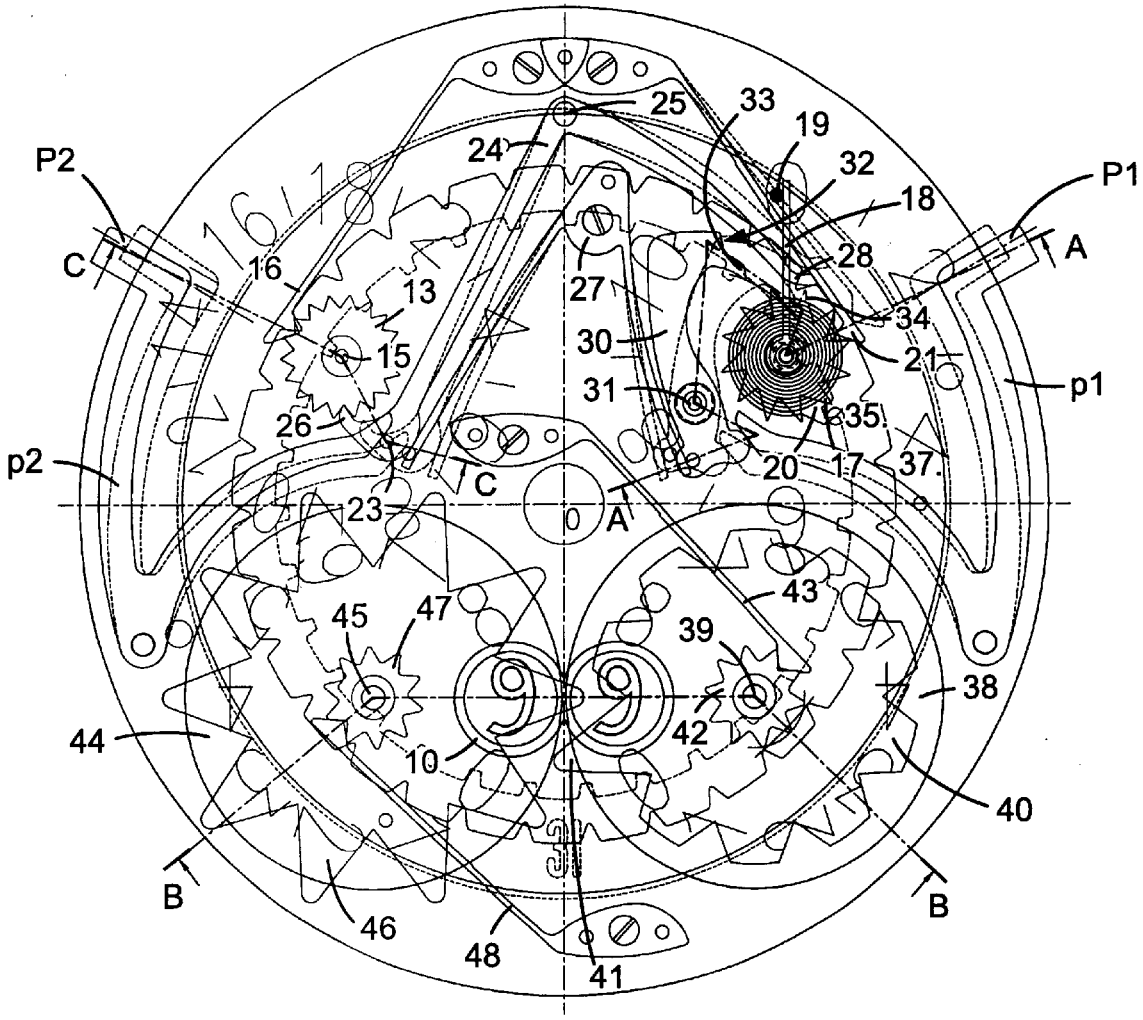
FIG. 2 is a plan view of the mechanism of the golf counter according to the invention.
Figure 3:
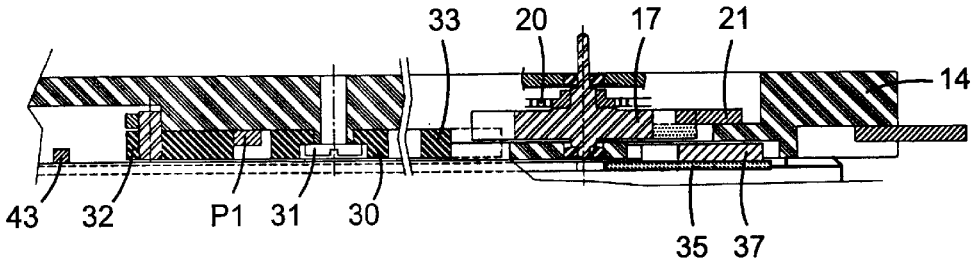
FIG. 3 is a cross-section on the line A—A of FIG. 2.
Figure 4:
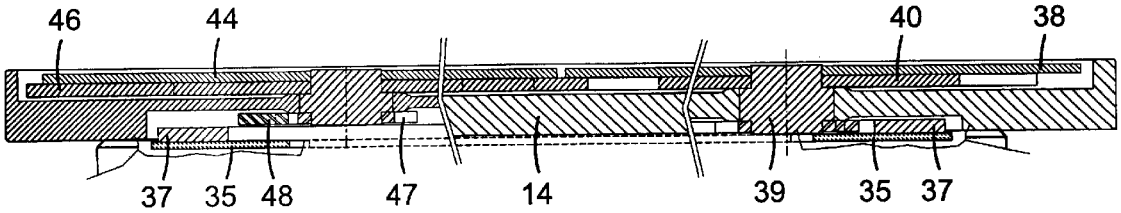
FIG. 4 is a cross-section on the line B—B of FIG. 2.
Figure 5:
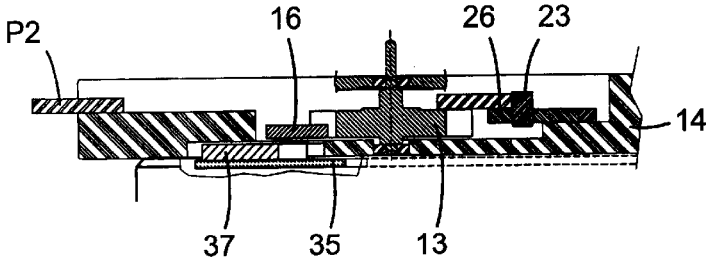
FIG. 5 is a cross-section on the line C—C of FIG. 2.

As is seen in FIG. 1, the golf counter comprises a case 1 enclosing a mechanism and the movement of a watch whose dial 2 carries a graduation 3 for time display, coacting with an hour hand 4 and a minute hand 5, driven by the watch movement.

The dial 2 moreover carries two counting graduations, one graduation 6 forming with a hand 7 the display of the number of the hole played, and the other graduation 8 forming with a hand 9 the display of the number of strokes taken for the hole displayed on the counter 6, 7.

The dial 2 also comprises a window 10 through which the numerals carried by the display discs can appear, this window and these discs forming a totalizing counter of the number of strokes taken.

The case 1 comprises a winding stem 11 and two pushbuttons P1 and P2 actuating correcting levers p1 and p2 acting on the mechanism of the golf counter as will be described hereafter.

In the illustrated example, the case 1 enclosing the watch movement and the golf counter mechanism, located between said movement and the dial 2, is fixed on a watch strap 12.

It is evident that in a simplified embodiment, the case 1 could enclose only the golf counter, the dial 2 then not bearing any time graduations.

In other modifications, the case need not be fixed on a watch strap and could comprise for example a disc permitting it to be suspended from a cord or a chain permitting carrying the golf counter as a pocket watch or a pendant.

FIGS. 2 to 5 show in detail the mechanism, which is purely mechanical, of the golf counter, permitting actuating the displays 6, 7; 8, 9 and 10 with the help of pushbuttons P1 and P2 and the winding crown 11.

This mechanism comprises a second star wheel 13 with eighteen teeth pivoted on a base plate 14 of the golf counter module. The axle 15 of this eighteen-toothed star wheel 13 bears the hand 7 of the counter displaying the number of the hole being played. The angular position of this eighteen-tooth star wheel 13 is maintained by its successive stepwise actuations, by a spring detent 16.

This mechanism also comprises a first twelve-tooth star wheel 17 also pivoted on the base plate 14 of the golf counter module, whose axle carries the hand 9 of the counter 8, 9 totalizing the number of strokes taken for a given hole. This twelve-toothed star wheel has a stop finger 18 coacting with a pin 19 set into the base plate 14 to define the 0 position of the needle 9 of the counter of the number of strokes per hole. This twelve-toothed star wheel is subjected to the action of a spiral return spring 20, and a spring detent 21 maintains its angular position between its successive actuations.

The shaft p2 of the pushbutton P2 bears at its end a pin 23 acting on one of the arms of a second lever 24 pivoted at 25 on the base plate 14. This first arm of the second lever 24 ends in a nose 26 adapted to coact with the teeth of the second eighteen-tooth star wheel 13. This first arm of the second lever 24 is subjected to the return action of a spring 27 fixed on the base plate 14, comprising two legs, of which the first bears on the pin 23. This first leg of the spring 27 tends to maintain the shaft of the pushbutton P2 in its inactive position.

The second arm of the lever 24 bears with its end 28 on the spring detent 21 of the first twelve-toothed star wheel 17.

The shaft p1 of the pushbutton P1 bears on a projection of a first lever 30 pivoted at 31 on the base plate. This first lever 30 is subjected to the return action of the second leg of the spring 27.

The other end of the first lever 30 comprises an actuating surface 32 and a control nose 33 adapted to act on the teeth of the first twelve-tooth star wheel 17. This control nose 33 enters into contact only with the lower half of the teeth of the twelve-toothed star wheel 17. This first twelve-toothed star wheel 17 comprises a tooth 34 whose thickness is reduced and accordingly cannot coact with the nose 33.

This mechanism also comprises a first crown 35, having internal teeth, actuated conventionally by the winding stem 11 when the latter is in its intermediate position. The first crown 35 carries a second crown 37 also comprising internal teeth, these internal teeth coacting with the actuating surface 32 of the lever 30.

The mechanism also comprises a disc 38 of units, provided on its upper face with numerals 0 to 9 uniformly spaced about its circumference, which numerals appear successively in the red portion of the window 10 of the dial. This units disc 38 is secured to an axle 39 pivoted on the base plate 14, this axle also carrying a units star wheel 40 comprising nine truncated teeth and a single entire tooth 41, as well as a pinion 42 subjected to the action of a spring detent 43. The teeth of this pinion 42 are disposed in the path of the internal teeth of the second crown 37.

Finally, this mechanism comprises a tens disc 44 carrying on its upper surface the numerals 0 to 9 disposed so as to appear successively in the left portion of the window 10 of the dial 2. This tens disc 44 is secured to an axle 45 pivoted on the base plate 14, this axle carrying a tens star wheel 46, whose six teeth coact with the tooth 41 of the units start wheel 40, and a pinion 47 subjected to the action of a spring detent 48.

The units disc 38 and the tens disc 44 are tangential and disposed so as to be able to cause two numerals to appear in the window 10 of the dial, each of these numerals being carried by one of said discs.

The operation of this golf counter mechanism is as follows:

In the initial or 0 position, the hand 7 faces the numeral 1 of the graduation 6 thereby indicating that it is the first hole of the course which is to be played. A hand 9 indicates 0 on the graduation 8, indicating that no stroke has been taken for hole number 1. Finally, the window 10 of the dial shows the indication 00, meaning that the total number of strokes played is 0.

The player can then enter the number of strokes necessary to reach the first hole. At each stroke, he pushes on the pushbutton P1, which swings the first lever 30, its nose 33 engages with the teeth of the twelve-tooth star 17, advancing it one step, which places the hand 9 on the numeral 1 of the graduation 8 of the dial 2. Simultaneously, the actuating surface 33 of this first lever 30 enters into contact with the teeth of the second crown 37 and moves the latter one step, resulting in driving the pinion 42 by one step, and hence the units disc 38 of the totalizing counter, which now indicates 01.

As with each push on the pushbutton P1, the player increments by one point the display 8, 9, indicating the number of strokes to the first hole and on the other hand the totalizing counter 10.

The maximum value of the display 8, 9 of the counter of the number of strokes per hole, is limited in the illustrated example to eleven. If nevertheless the user pushes a second time on the pushbutton P1, the nose 33 of the lever 30 does not drive the twelve-tooth star wheel 17, this nose passes beside the truncated tooth 34 of this star wheel 17. It is thus avoided that the capacity of the spiral spring 20 will be exceeded and that the spring will not be damaged.

Of course the maximum value of the counter 8, 9 depends on the number of teeth of the first star wheel 17 and on the number of marks of the graduation 8. This maximum capacity can therefore be chosen as desired.

When the pushbutton P1 is actuated for the second consecutive time, the tooth 41 of the units star wheel drives the tens star wheel by one step. This repeats each time the pushbutton P1 is actuated for the tenth consecutive time. Thus the totalizing counter is incremented from 0 to 99 at most, for each push on the pushbutton P1.

The first hole being completed, the player presses once on the pushbutton P2, which causes a pivoting of the second lever 24 and the displacement of the spring detent 21 by the bearing surface 28 of the second arm of this lever 24. As soon as the spring detent 21 is raised, the twelve-tooth star wheel 17 is driven counterclockwise by the spiral return spring 20, to its initial position defined by the stop finger 18 and the pin 19. The hand 9 of the counter of the number of strokes per hole is thus reset to 0. Upon releasing the pushbutton P2, the nose 26 of the first arm of the lever 24 engages, under the action of the spring 27, with a second eighteen-tooth star wheel 13 and causes its rotation by one step, moving the hand 7 to the numeral 2 of the graduation 6 indicating the number of the hole played.

These 0 reset functions of the counter of the number of strokes 8, 9 per hole, and the incrementation of the counter 6, 7 of the number of the hole, do not in any way influence the totalizing counter 10.

These operations are repeated to the end of the round, namely the totalization of the number of strokes taken for the 18th hole on the counter 8, 9 and the total number of strokes of the player on the totalizing counter 10.

Before the beginning of a new round, the player resets to 0 the totalizing counter by placing the winding stem 11 in the intermediate position if it is a watch provided with a golf counter, then by actuating with the help of this crown 11 the first crown 35 which, driving the crown 37, permits a manual 0 resetting of the totalizing counter.

The mechanism described is of interest because it is simple, and comprises only a few pieces that are easy to be machined. Such a mechanism is particularly much less complicated than a mechanism which would comprise cores for 0 resetting of the counters, as is found in chronographic mechanisms.

Many variations of the mechanism described are possible. It has already been mentioned that it could be integrated or not into a watch and that the maximum value of the counter 8, 9 for the number of strokes per hole is changeable as desired. The same is true for the maximum value of the counter 6, 7 of the hole number. Thus, it suffices to modify accordingly the number of teeth of the eighteen-tooth star wheel and of the marks of the graduation 6.

A simplified version could also be made, of the mechanism, which would not comprise any totalizing counter.

Moreover, the counters 6, 7 of the number of the hole played, and 8, 9 of the number of strokes for the played hole, could comprise, instead of a hand, a rotating disc provided with numeral on its upper surface, which numerals would be visible one by one through a window of the dial.

What is claimed is:

1. A golf counter comprising:

at least one counter indicating the number of a hole played;

a counter of the number of strokes per hole;

a first pushbutton incrementing the counter of the number of strokes per hole;

a second pushbutton incrementing the counter of the number of the hole played and simultaneously resetting to zero the counter of the number of strokes per hole;

said golf counter being entirely mechanical and having a mechanism which comprises a first lever actuated by the first pushbutton against the action of a return spring;

said first lever having an end with a nose coacting with a first star wheel bearing a first movable member of the counter of the number of strokes per hole;

said first star wheel being subjected to the action of a first spring detent and a spiral return spring; a second lever having a first arm and a second arm;

said first arm being subjected to the action of the return spring and operationally connected to the second pushbutton; said first arm having a nose coacting with teeth of a second star wheel carrying a second movable member of the counter of the hole number and subject to the action of a second spring detent;

said second arm actuating during pivoting under the action of the second pushbutton, the first spring detent thereby freeing the first star wheel leading to a zero resetting by the spiral spring; and the nose of the first arm of the second lever causing an incrementation of the second star wheel when the second pushbutton returns to a rest position.

2. The counter according to claim 1, wherein the counter of the hole number and the counter of the number of strokes per hole comprise a graduation fixed to a dial and a hand coacting with the corresponding graduation.

3. The counter according to claim 1, wherein the counter of the number of the hole played and the counter of the number of strokes per hole comprise a window provided in a dial and a rotatable disc bearing numerals on an upper surface of the rotatable disc, and appearing in turn in the corresponding window.

4. The counter according to claim 1, further comprising a totalizing counter of the number of strokes taken, formed by two tangential rotatable discs bearing numerals on their upper surface and appearing in turn through a window of a dial; said two rotatable discs comprising a tens disc secured to a tens star wheel with six teeth and a pinion subject to the action of a third spring detent; and a units disc secured to a units star wheel comprising a tooth coacting with the teeth of the tens star wheel and a pinion subject to the action of a fourth spring detent; and a second crown having internal teeth coacting with the teeth of the pinion of the units star wheel and with an actuating surface of the first lever.

5. The counter according to claim 4, further comprising a zero resetting device for the totalizing counter comprising a first crown having internal teeth; said first crown being secured to the second crown and being angularly movable thanks to a rewinding crown.

6. The counter according to claim 1, wherein the mechanism is mounted on a base plate thereby forming a module.

7. The counter according to claim 6, wherein the module constituting the mechanism of the golf counter is integrated between a timepiece movement and a dial.

8. The counter according to claim 1, wherein the nose of the first lever coacts with only a portion of the height of the teeth of the first star wheel, and the star wheel comprises a tooth of less height that cannot be actuated by said nose of the first lever.

* * * * *